US007072482B2

(12) United States Patent
Van Doorn et al.

(10) Patent No.: US 7,072,482 B2
(45) Date of Patent: Jul. 4, 2006

(54) MICROPHONE WITH IMPROVED SOUND INLET PORT

(75) Inventors: Jan Marinus Van Doorn, Alkmaar (NL); Mike Geskus, Purmerend (NL); Thomas Andreas Raymann, Rapperswill (CH)

(73) Assignee: Sonion Nederland B.V., Amsterdam (NL)

( * ) Notice: Subject to any disclaimer, the term of this patent is extended or adjusted under 35 U.S.C. 154(b) by 127 days.

(21) Appl. No.: 10/236,649

(22) Filed: Sep. 6, 2002

(65) Prior Publication Data

US 2004/0047486 A1 Mar. 11, 2004

(51) Int. Cl.
*H04R 9/08* (2006.01)
*H04R 25/00* (2006.01)

(52) U.S. Cl. ..... 381/355; 381/357; 381/322

(58) Field of Classification Search ..... 381/355, 381/356, 357, 358, 360, 369, 322
See application file for complete search history.

(56) References Cited

U.S. PATENT DOCUMENTS

| | | | | |
|---|---|---|---|---|
| 2,143,097 | A | 1/1939 | Warnke | 179/119 |
| 2,912,523 | A | 11/1959 | Knowles et al. | 179/108 |
| 2,994,016 | A | 7/1961 | Tibbetts et al. | 317/172 |
| 2,998,804 | A | 9/1961 | Clement | 121/41 |
| 3,002,058 | A | 9/1961 | Knowles | 179/114 |
| 3,013,127 | A | 12/1961 | Christensen et al. | 179/114 |
| 3,154,172 | A | 10/1964 | Tibbetts | 181/32 |
| 3,163,723 | A | 12/1964 | Tibbetts | 179/180 |
| 3,177,412 | A | 4/1965 | Carlson | 317/173 |
| 3,193,048 | A | 7/1965 | Kohler | 181/31 |
| 3,249,702 | A | 5/1966 | Carlson | 179/115 |
| 3,251,954 | A | 5/1966 | Carlson | 179/115 |
| 3,413,424 | A | 11/1968 | Carlson | 179/115 |
| 3,491,436 | A | 1/1970 | Carlson | 29/594 |
| 3,531,745 | A | 9/1970 | Tibbetts | 335/231 |
| 3,536,861 | A | 10/1970 | Dunlavy | 179/107 |
| 3,560,667 | A | 2/1971 | Carlson | 179/114 |
| 3,577,020 | A | 5/1971 | Carlson et al. | 310/8.2 |
| 3,617,653 | A | 11/1971 | Tibbets et al. | 179/114 A |
| 3,671,684 | A | 6/1972 | Tibbets et al. | 179/117 |
| 3,681,531 | A | 8/1972 | Burkhard et al. | 179/1 J |
| 3,681,756 | A | 8/1972 | Burkhard et al. | 340/172.5 |
| 3,692,264 | A | 9/1972 | Burkhard et al. | 248/15 |

(Continued)

FOREIGN PATENT DOCUMENTS

EP 0 094 992 B1 9/1986

(Continued)

OTHER PUBLICATIONS

Shust, Michael R., et al., "Electronic Removal Of Outdoor Microphone Wind Noise," Acoustical Society of America 136th Meeting Lay Language Papers, 5 pages (Oct. 13, 1998).

*Primary Examiner*—Sinh Tran
*Assistant Examiner*—Brian Ensey
(74) *Attorney, Agent, or Firm*—Jenkens & Gilchrist

(57) ABSTRACT

A microphone comprises a housing defining an inner volume and including a first exterior surface with an aperture leading to the inner volume. The microphone includes a transducing assembly within the housing for converting sound into an electrical signal. A sound inlet plate defines, typically in combination with the first exterior surface, a passageway for transmitting sound to the aperture The passageway receives the sound from an opening in the sound inlet plate. The opening is offset from the location at which the aperture is positioned on the exterior surface. The sound inlet plate is made very thin so that it does not extend substantially away from the housing.

38 Claims, 5 Drawing Sheets

U.S. PATENT DOCUMENTS

| | | | | |
|---|---|---|---|---|
| 3,701,865 | A | 10/1972 | Carlson et al. | 179/181 R |
| 3,740,796 | A | 6/1973 | Carlson et al. | 179/111 E |
| 3,766,332 | A | 10/1973 | Carlson et al. | 179/114 A |
| 3,770,911 | A | 11/1973 | Knowles et al. | 179/107 S |
| 3,772,133 | A | 11/1973 | Schmitt | 161/112 |
| 3,835,263 | A | 9/1974 | Killion | 179/107 FD |
| 3,855,555 | A | 12/1974 | Burkhard et al. | 332/11 D |
| 3,930,560 | A | 1/1976 | Carlson et al. | 181/160 |
| 3,935,398 | A | 1/1976 | Carlson et al. | 179/114 A |
| 4,006,321 | A | 2/1977 | Carlson | 179/180 |
| 4,063,034 | A | 12/1977 | Peters | 179/1 J |
| 4,063,050 | A | 12/1977 | Carlson et al. | 179/111 E |
| 4,149,032 | A | 4/1979 | Peters | 179/1 CN |
| 4,151,480 | A | 4/1979 | Carlson et al. | 330/277 |
| 4,189,627 | A | 2/1980 | Flanagan | 179/180 |
| 4,272,654 | A | 6/1981 | Carlson | 179/119 A |
| 4,450,930 | A | 5/1984 | Killion | 181/158 |
| 4,509,193 | A | 4/1985 | Carlson | 381/113 |
| 4,567,382 | A | 1/1986 | van Halteren | 307/400 |
| 4,592,087 | A | 5/1986 | Killion | 381/68 |
| 4,592,087 | A | 5/1986 | Killion | 381/68 |
| 4,689,819 | A | 8/1987 | Killion | 381/68 |
| 4,689,819 | A | 8/1987 | Killion | 381/68 |
| 4,730,283 | A | 3/1988 | Carlson et al. | 367/181 |
| 4,764,690 | A | 8/1988 | Murphy et al. | 307/400 |
| 4,800,982 | A | 1/1989 | Carlson | 181/130 |
| 4,807,612 | A | 2/1989 | Carlson | 128/868 |
| 4,815,138 | A | 3/1989 | Diethelm | 381/69.2 |
| 4,815,560 | A | 3/1989 | Madaffari | 181/158 |
| 4,837,833 | A | 6/1989 | Madaffari | 381/69 |
| 4,867,267 | A | 9/1989 | Carlson | 181/130 |
| 4,870,688 | A | 9/1989 | Voroba et al. | 381/60 |
| 4,908,805 | A | 3/1990 | Sprenkels et al. | 367/181 |
| 4,910,840 | A | 3/1990 | Sprenkels et al. | 29/25.41 |
| 4,956,868 | A | 9/1990 | Carlson | 381/189 |
| RE33,718 | E | 10/1991 | Carlson et al. | 367/181 |
| 5,068,901 | A | 11/1991 | Carlson | 381/68.6 |
| 5,083,095 | A | 1/1992 | Madaffari | 330/277 |
| 5,101,435 | A | 3/1992 | Carlson | 381/68.6 |
| 5,193,116 | A | 3/1993 | Mostardo | 381/69 |
| 5,222,050 | A | 6/1993 | Marren et al. | 367/163 |
| 5,255,246 | A | 10/1993 | van Halteren | 367/170 |
| 5,319,717 | A | 6/1994 | Holesha | 381/168 |
| 5,335,286 | A | 8/1994 | Carlson et al. | 381/191 |
| 5,337,011 | A | 8/1994 | French et al. | 330/258 |
| 5,380,965 | A | 1/1995 | Møller | 200/11 R |
| 5,408,534 | A | 4/1995 | Lenzini et al. | 381/191 |
| D360,948 | S | 8/1995 | Mostardo | D24/174 |
| D360,949 | S | 8/1995 | Mostardo | D24/174 |
| 5,446,413 | A | 8/1995 | Loeppert et al. | 330/277 |
| 5,548,658 | A | 8/1996 | Ring et al. | 381/191 |
| 5,559,892 | A | 9/1996 | Boor | 381/68.4 |
| 5,579,398 | A * | 11/1996 | Ewens | 381/338 |
| 5,610,989 | A | 3/1997 | Salvage et al. | 381/69 |
| 5,647,013 | A | 7/1997 | Salvage et al. | 381/192 |
| 5,692,060 | A | 11/1997 | Wickstrom | 381/169 |
| 5,708,721 | A | 1/1998 | Salvage et al. | 381/69 |
| 5,740,261 | A | 4/1998 | Loeppert et al. | 381/168 |
| 5,757,947 | A | 5/1998 | Van Halteren et al. | 381/200 |
| 5,796,848 | A | 8/1998 | Martin | 381/68.2 |
| 5,809,158 | A | 9/1998 | van Halteren et al. | 381/200 |
| 5,861,779 | A | 1/1999 | Loeppert et al. | 330/277 |
| 5,870,482 | A | 2/1999 | Loeppert et al. | 381/174 |
| 5,878,147 | A | 3/1999 | Killion et al. | 381/313 |
| 5,920,090 | A | 7/1999 | Stenberg | 257/252 |
| D414,493 | S | 9/1999 | Jiann-Yeong | D14/225 |
| 5,960,093 | A | 9/1999 | Miller | 381/324 |
| 6,012,021 | A | 1/2000 | Rombach et al. | 702/150 |
| 6,041,131 | A | 3/2000 | Kirchhoefer et al. | 381/415 |
| 6,075,867 | A | 6/2000 | Bay et al. | 381/191 |
| 6,075,869 | A | 6/2000 | Killion et al. | 381/313 |
| 6,075,870 | A | 6/2000 | Geschiere et al. | 381/417 |
| 6,078,677 | A | 6/2000 | Dolleman et al. | 381/418 |
| 6,084,972 | A | 7/2000 | van Halteren et al. | 381/92 |
| 6,088,463 | A | 7/2000 | Rombach et al. | 381/174 |
| H1875 | H | 10/2000 | Dames | 310/322 |
| 6,134,334 | A | 10/2000 | Killion et al. | 381/356 |
| 6,169,810 | B1 | 1/2001 | van Halteren et al. | 381/174 |
| 6,307,944 | B1 | 10/2001 | Garratt et al. | 381/312 |
| 6,324,907 | B1 | 12/2001 | Halteren et al. | 73/431 |
| 6,353,344 | B1 | 3/2002 | Lafort | 327/108 |
| 6,681,021 | B1 * | 1/2004 | Saltykov | 381/328 |
| 2001/0008559 | A1 | 7/2001 | Roo | 381/92 |
| 2001/0012375 | A1 | 8/2001 | Miller et al. | 381/418 |
| 2001/0033671 | A1 | 10/2001 | Kearey | 381/355 |
| 2001/0036287 | A1 | 11/2001 | Beard et al. | 381/313 |
| 2001/0036289 | A1 | 11/2001 | Nepomuceno | 381/324 |
| 2001/0043705 | A1 | 11/2001 | Wilmink | 381/120 |
| 2002/0003890 | A1 | 1/2002 | Warren et al. | 381/418 |
| 2002/0006211 | A1 | 1/2002 | Geskus | 381/356 |
| 2002/0009206 | A1 | 1/2002 | Jorgensen et al. | 381/356 |
| 2002/0021816 | A1 | 2/2002 | Collins | 381/369 |
| 2002/0021817 | A1 | 2/2002 | Miller | 381/369 |
| 2002/0039428 | A1 | 4/2002 | Svajda et al. | 381/331 |
| 2002/0050377 | A1 | 5/2002 | Augustijn et al. | 174/52.1 |
| 2002/0061113 | A1 | 5/2002 | van Halteren et al. | 381/322 |
| 2002/0067663 | A1 | 6/2002 | Loeppert et al. | 367/181 |
| 2002/0094101 | A1 | 7/2002 | De Roo et al. | 381/356 |
| 2002/0102004 | A1 | 8/2002 | Minervini | 381/175 |
| 2002/0106828 | A1 | 8/2002 | Loeppert | 438/53 |

FOREIGN PATENT DOCUMENTS

| | | |
|---|---|---|
| EP | 0 664 942 B1 | 2/1997 |
| EP | 0 924 958 A1 | 6/1999 |
| EP | 0 969 695 A1 | 1/2000 |
| EP | 0 982 971 A2 | 3/2000 |
| EP | 1 030 320 A1 | 8/2000 |
| EP | 1 052 880 A2 | 11/2000 |
| EP | 1 077 586 A2 | 2/2001 |
| EP | 1 077 587 A2 | 2/2001 |
| NL | 6602799 | 9/1967 |
| WO | WO 94/09607 A1 | 4/1994 |
| WO | WO 94/13116 A1 | 6/1994 |
| WO | WO 95/07014 A1 | 3/1995 |
| WO | WO 95/22879 A2 | 8/1995 |
| WO | WO 95/22879 A3 | 8/1995 |
| WO | WO 98/35530 A1 | 8/1998 |
| WO | WO 99/31937 A1 | 6/1999 |
| WO | WO 99/51060 A1 | 10/1999 |
| WO | WO 99/63652 A1 | 12/1999 |
| WO | WO 00/38477 A2 | 6/2000 |
| WO | WO 00/60902 A1 | 10/2000 |
| WO | WO 00/62580 A1 | 10/2000 |
| WO | WO 00/67526 A2 | 11/2000 |
| WO | WO 00/67526 A3 | 11/2000 |
| WO | WO 00/74435 A2 | 12/2000 |
| WO | WO 00/74435 A3 | 12/2000 |
| WO | WO 00/74436 A2 | 12/2000 |
| WO | WO 00/74436 A3 | 12/2000 |
| WO | WO 00/74437 A1 | 12/2000 |
| WO | WO 01/14248 A2 | 3/2001 |
| WO | WO 01/14248 A3 | 3/2001 |
| WO | WO 01/26413 A2 | 4/2001 |
| WO | WO 01/43498 A1 | 6/2001 |
| WO | WO 01/52598 A1 | 7/2001 |
| WO | WO 01/67843 A2 | 9/2001 |
| WO | WO 01/67843 A3 | 9/2001 |
| WO | WO 01/78446 A1 | 10/2001 |
| WO | WO 02/28140 A2 | 4/2002 |
| WO | WO 02/45461 A2 | 6/2002 |

* cited by examiner

MICROPHONE WITH IMPROVED SOUND INLET PORT

FIELD OF THE INVENTION

The present invention relates generally to electroacoustic transducers and, in particular, to a microphone or listening device with an improved sound inlet port.

BACKGROUND OF THE INVENTION

Miniature microphones, such as those used in hearing aids, convert acoustical sound waves into an audio signal, which is processed (e.g., amplified) and sent to a receiver of the hearing aid. The receiver then converts the processed signal to acoustical sound waves that are broadcast towards the eardrum. In one typical microphone, a moveable diaphragm and a charged backplate convert the sound waves into the audio signal. The diaphragm divides the inner volume of the microphone into a front volume and a rear volume Sound waves enter the front volume of the microphone via a sound inlet.

Most prior art microphones, such as the prior art microphone of FIG. 1, have a sound inlet that includes a large inlet nozzle for receiving sound from the ambient environment. The large dimensions of the inlet nozzle can be a problem because hearing aids often have very limited space.

Further, the front volume and back volume within the microphone housing are typically of different sizes, causing the inlet nozzle, which is placed near the front volume, to be located asymmetrically on one of the exterior surfaces Mounting a microphone having an inlet nozzle asymmetrically located on its exterior surface can be problematic in some types of hearing aids because the inlet nozzle must be aligned with the hearing aid's opening to the ambient environment in the hearing aid while the microphone is positioned in a spatially constrained location.

SUMMARY OF THE INVENTION

The present invention solves the aforementioned problems by providing a novel sound inlet plate that mates with the microphone The microphone comprises a housing with an inner volume and a first exterior surface with an aperture leading to the inner volume The microphone includes a transducing assembly within the housing for converting sound into an electrical signal The inventive sound inlet plate is mounted on the first exterior surface and defines (possibly in combination with the first exterior surface) a passageway for transmitting sound to the aperture leading to the inner volume. The passageway receives the sound from an opening in the sound inlet plate, the opening being offset from the location at which the aperture is positioned on the first exterior surface. The sound inlet plate is made very thin so that it does not extend substantially away from the housing. Further, the location of the opening of the sound inlet can be offset to a more desirable position (e.g., the midpoint of the microphone exterior surface) to ease installation of the microphone in the hearing aid.

The inventive sound inlet plate is useful on omni-directional and directional microphones The above summary of the present invention is not intended to represent each embodiment, or every aspect, of the present invention. This is the purpose of the Figures and the detailed description which follow.

BRIEF DESCRIPTION OF THE DRAWINGS

The foregoing and other advantages of the invention will become apparent upon reading the following detailed description and upon reference to the drawings.

Figure 1A:
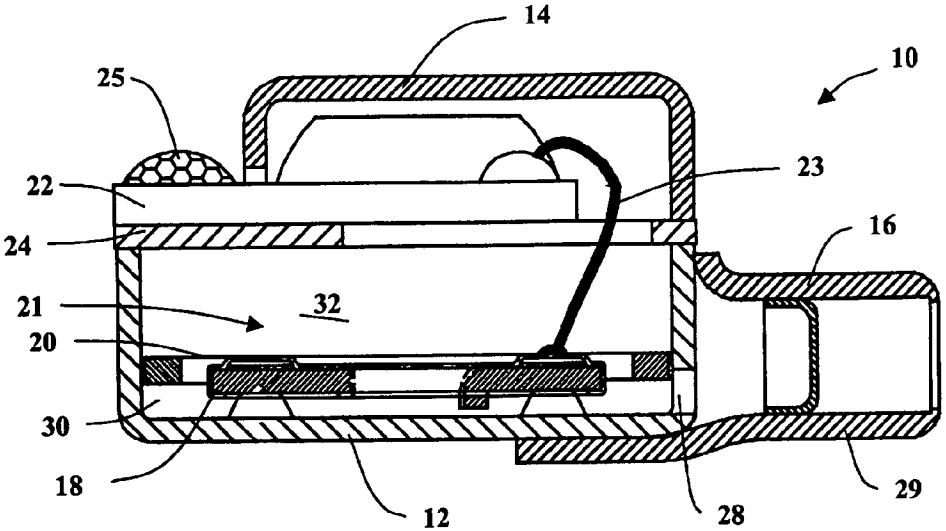
FIG. 1A Prior Art
FIGS. 1A and 1B illustrate a prior art microphone.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Figure 1B:
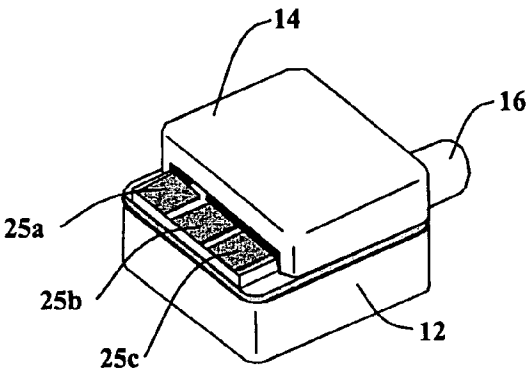
FIG. 1B Prior Art

FIGS. 1A–1B illustrate a typical prior art microphone 10 The microphone 10 includes a case or housing 12, a cover 14, and a sound inlet nozzle 16 through which sound enters the housing 12. Within the housing 12, a backplate 18 having a charged electret layer works in conjunction with a moveable diaphragm 20 to convert (i.e., transduce) the sound into an electrical signal. The combination of the backplate 18 and the diaphragm 20 is generally referred to as an electret-type transducing assembly 21, although the present invention is useful with other types of transducing assemblies, as well A printed circuit board 22 is mounted on a mounting plate 24 The signal from the transducing assembly 21 is sent to the printed circuit board 22 via a wire connection 23 The signal is processed on the printed circuit board 22 (e.g. amplified) to produce an output signal Because only a portion of the printed circuit board 22 is covered by the cover 14, one of the set of contacts 25*a* (FIG. 1B) on the printed circuit board provides the output signal from the microphone 10. The other two contacts 25*b*, 25*c* (FIG. 1B) are a ground connection and an input power connection, respectively.

In this typical prior art microphone 10, sound reaches the interior of the housing 12 via the sound inlet nozzle 16 and the aperture 28. The inlet nozzle 16 may have a screen 29 to provide dampening and to serve as a shield for keeping foreign objects from entering the housing 12 Within the housing 12, the sound propagates through a front volume 30 and acts upon the diaphragm 20, which separates the front volume 30 from a back volume 32. The diaphragm 20 moves relative to the backplate 18 in response to the sound causing the backplate 18 to generate the electrical signal corresponding to the pressure change associated with the sound One embodiment of the present invention is disclosed in FIGS. 2A and 2B. A cup-shaped sound input plate 50 includes an outer wall 52 and an interior recess 54. A sound port 56, which is an opening in the outer wall 52, leads to the interior recess 54. The interior recess 54 is configured to be large enough to overlap with an aperture 60 (shown in dashed lines) in the housing of a microphone leading to the transducing assembly, like the aperture 28 in FIG. 1A Because the plate 50 is designed for miniature microphones, the largest dimensions of the plate 50 are on the order of millimeters. By way of example only, the plate 50 in FIG. 2 may have a width of about 2 mm to 3 mm and a height of only about 1 mm. The overall thickness is less than 0.5 mm and the interior recess 54 has a depth that is between 0.1 mm and 0.2 mm. The area of the sound inlet port 56 is generally less than about 0.5 $mm^2$ and typically about 0.2 $mm^2$ to about 0.3 $mm^2$.

Figure 2A:
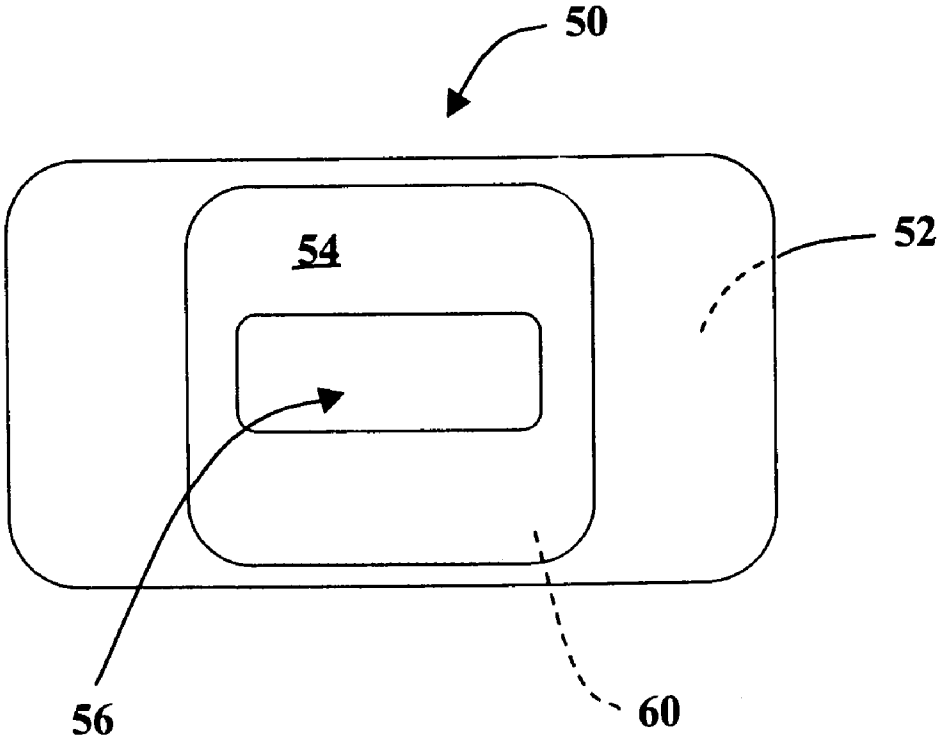
FIG. 2A is a front view of a sound inlet plate according to the present invention
Figure 2B:
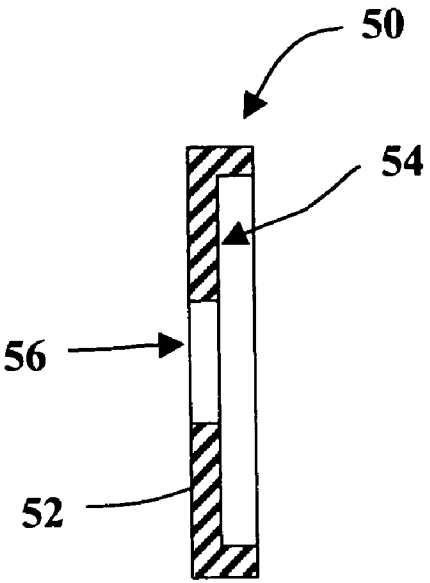
FIG. 2B is a cross-sectional view of the sound inlet plate of FIG. 2A.
Figure 3:
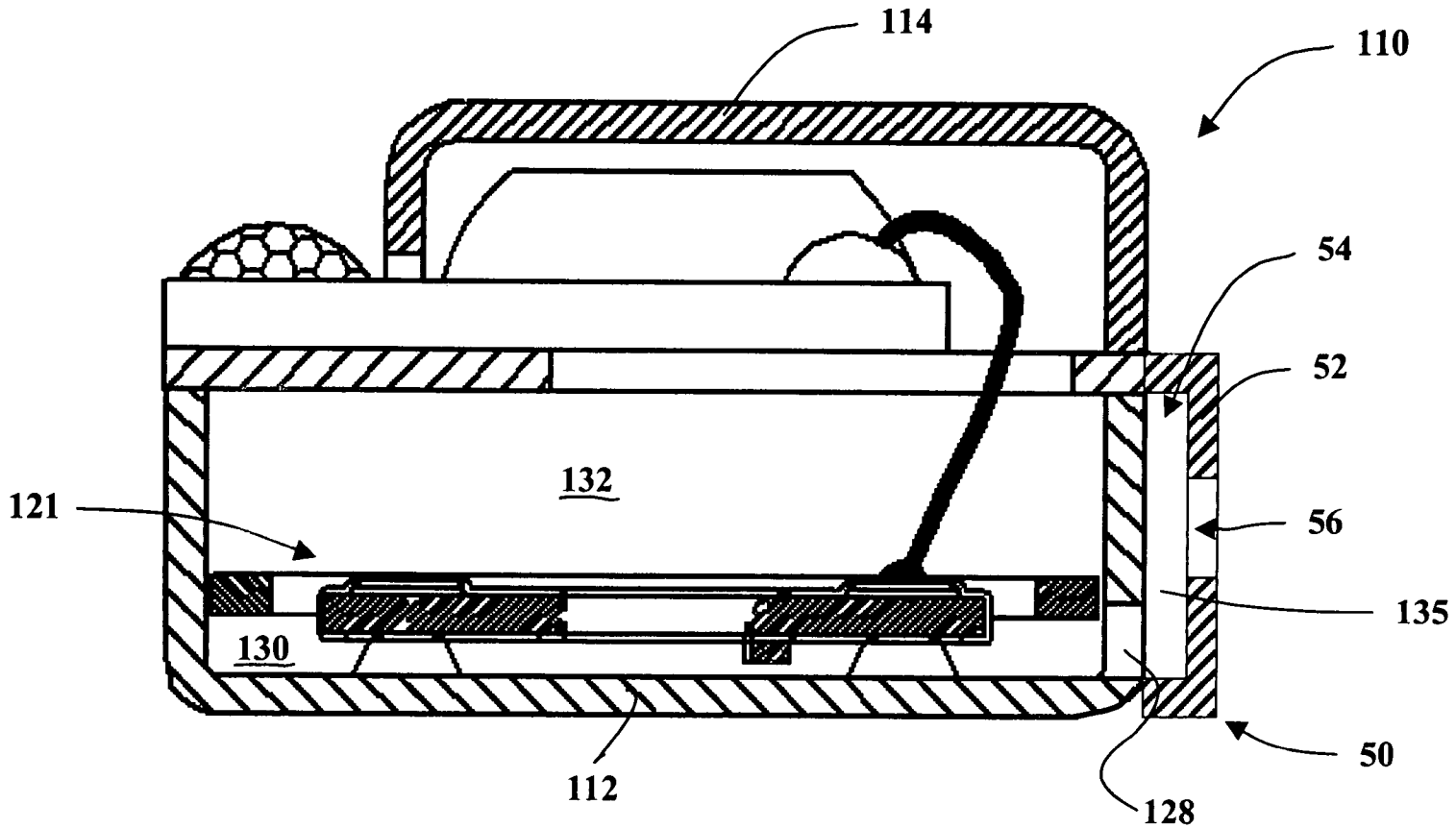
FIG. 3 is a cross-sectional view that illustrates the plate of FIG. 2 mounted on a microphone.

FIG. 3 illustrates the sound inlet plate 50 of FIG. 2 mounted on a microphone 110, which is substantially identical to the microphone 10 of FIG. 1, but includes 100-series reference numerals. The microphone 110 includes a housing 112 and a cover 114 for the housing 112. The housing 112 includes an aperture 128 that transmits sound to the transducing assembly 121, which divides the interior of the housing 112 into a front volume 130 and a back volume 132. The sound inlet plate 50 can be welded to the housing 112 or attached via an adhesive or glue.

In operation, the sound inlet plate 50 receives sound through the sound inlet port 56 in its exterior wall 52. The sound propagates through a passageway 135 that is defined by the interior recess 54 of the plate 50 and the exterior wall of the housing 112 adjacent to the aperture 128. Eventually, the sound is transmitted through the aperture 128 and acts upon the transducing assembly 121.

Unlike prior art systems where the sound inlet extends substantially away from the housing of the microphone (such as the nozzle 16 in FIGS. 1A and 1B), the sound inlet plate 50 only protrudes slightly away from the housing 112. One design aspect leading to the minimal protrusion feature of the plate 50 is the fact that the sound port 56 is simply an opening or hole in the outer wall 52. For example, in one embodiment, the plate 50 protrudes less than 0.5 mm from the housing 112 and, preferably, about only 0.3 mm from the housing 112. Relative to the housing 112, the thickness of the plate 50 is usually less than approximately four times the wall thickness of the housing 112 and, preferably, only about twice the wall thickness of the housing 112, as shown in the cross-sectional views of FIGS. 2B and 3. Thus, the microphone 110 has a more compact design as compared with the prior art microphone 10 of FIG. 1.

Another benefit of the design of the sound inlet plate 50 is that it can be designed to provide a sound passageway leading from a hearing aid sound receptacle that is offset from the aperture 128 in the housing 112. In other words, the hearing aid's sound receptacle receiving sound from the ambient environment may not be in alignment with the aperture 128 in the housing 112. By locating the sound port 56 at a point on the exterior wall 52 of the sound inlet plate 50 that is in alignment with the hearing aid's sound receptacle, the interior recess 54 and the exterior surface of the housing 112 immediately adjacent thereto define an appropriate passageway 135 leading to the aperture 128. In sum, the sound port 56 can be vertically and/or horizontally offset from the aperture 128 in the housing 112.

Further, because the performance of some microphones dictate that the front volume 130 be a much smaller size than the back volume 132, the aperture 128 is usually near a corner of a surface of the housing 112, substantially offset from the central region on the exterior surface of the housing 112. Thus, a sound inlet plate 50 can be selected for a particular microphone 110 so as to locate the sound inlet port 56 in the central region of the microphone 110, providing more symmetry to the location of the sound inlet relative to that exterior surface of the microphone 110. This can facilitate easier orientation of the microphone 110 while it is being mounted within the hearing aid.

A further benefit is that a manufacturer of microphones may need only one style of a sound inlet plate 50 for one or more types of microphones. The manufacturer can then maintain a large inventory of such plates 50 that lack the sound inlet port 56. Once a design specification or order is received from a hearing aid manufacturer dictating the offset of the sound inlet port 56 relative to the aperture 128, the manufacturer can then form the sound inlet ports 56 in the plates 50 at the appropriate position in the exterior wall 52.

Figure 4:
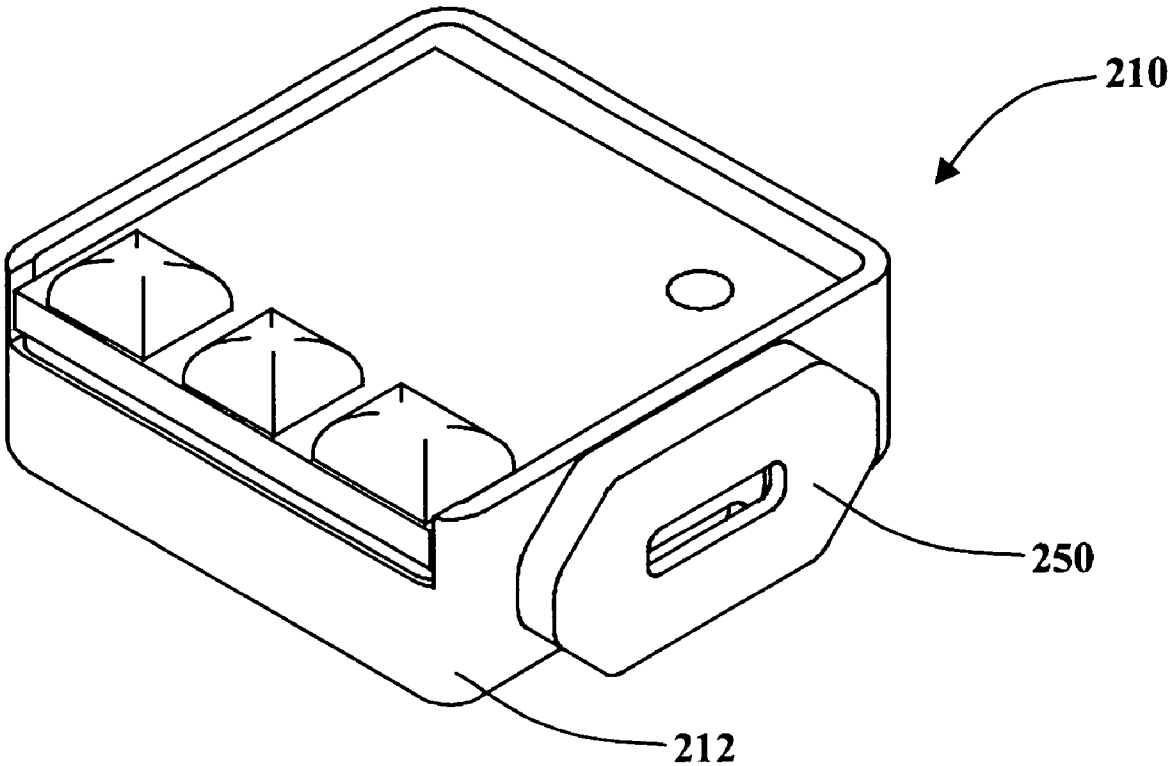
FIG. 4 is an isometric view of a sound inlet plate mounted on a microphone according to another embodiment of the present invention.

Additionally, the sound inlet plate 50 can be designed to have an acoustic inertance that helps to dampen the peak frequency response of the microphone 110. This can be accomplished by locating the sound inlet port 56 at a certain location relative to the aperture 128 and/or by providing a specific configuration to the interior recess 54. For example, instead of the recess 54 having the shape of a rounded rectangle, as shown in FIG. 2A, it could have an "S" shape, "C" shape, or any other type of shape that creates an elongated, narrow passageway leading to the aperture 128 in the housing 110. This passageway(s) can be in series or in parallel when leading to the aperture 128, so as to have a specific effect on the overall frequency response of the microphone 110 Alternatively, the depth of the interior recess 54 can be modified as well to affect the frequency response, and possibly be variable along the passageway that leads from the sound inlet port 56 to the aperture 128 of the housing 112. Further, although the size of the sound inlet port 56 is shown in the illustrative embodiment as being approximately the same size as the aperture 128 in the housing 112 (or aperture 60 in FIG. 2), the size of the sound inlet port 56 can be altered, as well. And, like the prior art microphone 10 in FIG. 1, the interior recess 54 may include a dampening material, such as a screen The exterior of the sound inlet plate 50 can have various shapes to accommodate different microphones 110 to which it is mounted. For example, FIG. 4 illustrates an alternative microphone 210 having a housing 212, but lacking a cover (like cover 114 in FIG. 2) The microphone 210 has a sound inlet plate 250 that has more of a flattened, ovular shape, which is different from the rounded rectangular shape of the plate 50 in FIG. 2A.

Additionally, the sound inlet plate may extend over two or more exterior housing surfaces such that the sound inlet port on the plate is adjacent to an exterior surface on the housing (or cover) that is perpendicular to the exterior surface on the housing where the aperture leading to the front volume is located. Further, the sound inlet plate may define the sound passage by itself (i e., the housing does not assist in defining the passageway) by including an interior wall opposite the exterior wall 52 that includes the sound port Such an interior would contact the housing of the microphone. And, while the present invention has been described with respect to a microphone, it can be used on other electroacoustic transducers, such as a receiver.

Figure 5B:
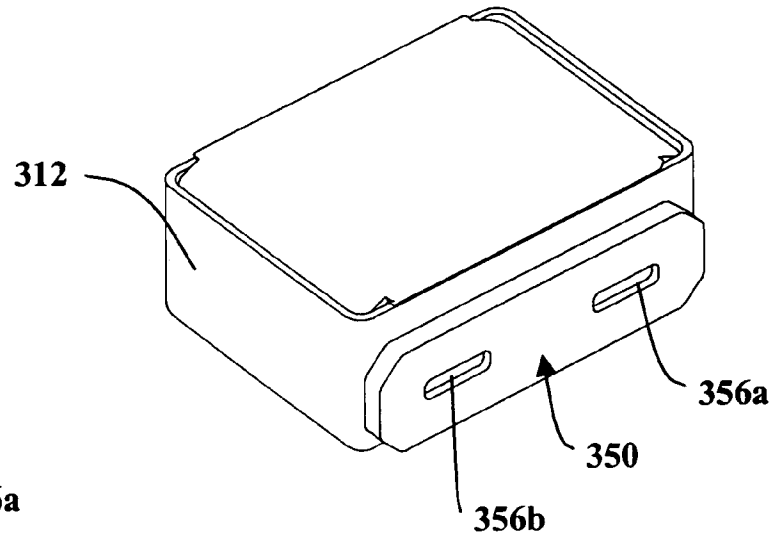
FIGS. 5A and 5B illustrate another embodiment of the present invention wherein a sound inlet plate is used on a directional microphone.
Figure 5A:
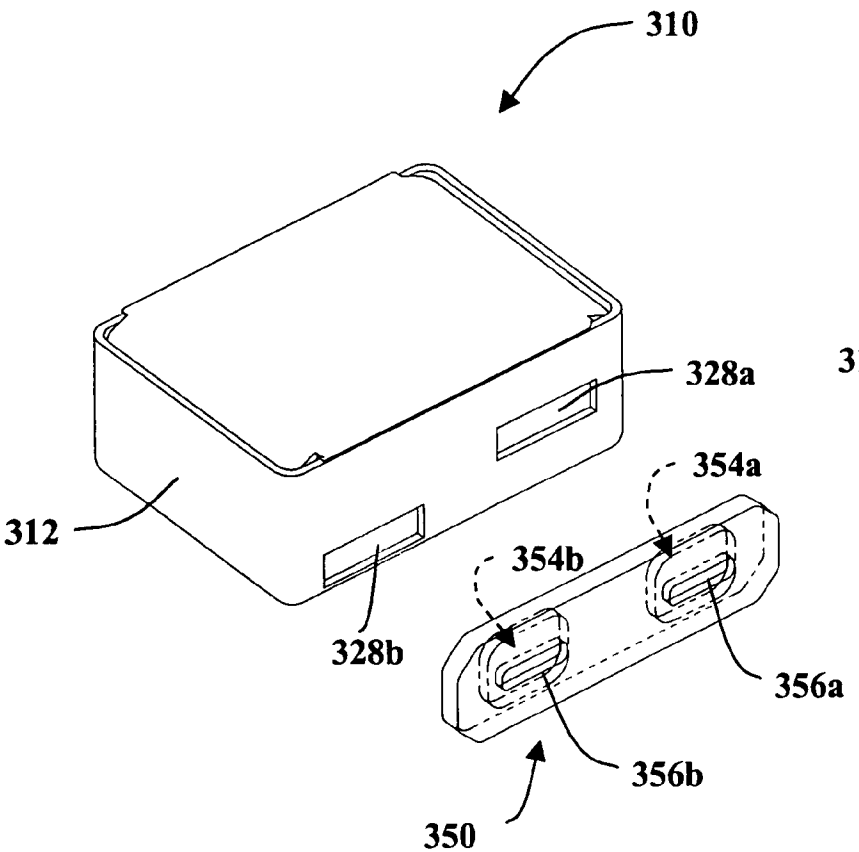

FIGS. 5A and 5B illustrate the invention in conjunction with a directional microphone 310. The directional microphone 310 includes a housing 312 with two apertures 328*a*, 328*b* for passing sound into the inner volume on both sides of the transducing assembly. A sound inlet plate 350 includes two recesses 354*a*, 354*b* for placement over respective ones of the apertures 328*a*, 328*b*. Two sound ports 356*a*, 356*b* lead into respective ones of the apertures 328*a*, 328*b*.

The sound inlet plate 350 can be designed to increase or decrease the spacing between the sound ports 356 without changing the spacing between the apertures 328 to affect the performance of the directional microphone 310. Additionally, the plate 350 can be formed around a plurality of exterior surfaces on the housing 312 (e.g., having an "L" shape while fitting on two exterior surfaces). And, the recesses 354*a*, 354*b* can be independently designed to attain a certain (and different, if so desired) acoustical characteristic (e.g., acoustical inertance) in each recess 354. Finally, the plate 350 can be replaced by two independent plates, each of which leads to a corresponding one of the two sound inlet ports 356

While the present invention has been described with reference to one or more particular embodiments, those skilled in the art will recognize that many changes may be made thereto without departing from the spirit and scope of the present invention Each of these embodiments and obvious variations thereof is contemplated as falling within the spirit and scope of the claimed invention, which is set forth in the following claims.

What is claimed is:

1. A microphone, comprising:

a housing defining an inner volume and including a first exterior surface with an aperture leading to said inner volume;

a transducing assembly dividing said inner volume into a front volume and a rear volume, said transducing assembly for converting sound into an electrical signal; and a plate coupled to said first exterior surface of said housing and including a primary flat wall generally parallel to and spaced away from said first exterior surface, said primary flat wall including a sound inlet port, said plate defining a passageway between said sound inlet port and said aperture for transmitting said sound to said front volume in said housing, said sound inlet port being an opening in said primary flat wall of said plate, being coplanar with an external surface of said primary flat wall and being offset from said aperture in said first exterior surface, said passageway being the only sound path leading through said plate and into said inner volume within said housing.

2. The microphone of claim 1, wherein said sound inlet port is vertically offset from said aperture in said first exterior surface.

3. The microphone of claim 1, wherein said sound inlet port is horizontally offset from said aperture in said first exterior surface.

4. The microphone of claim 1, wherein said passageway is also defined by said first exterior surface.

5. The microphone of claim 1, wherein said sound inlet port has an area that is approximately the same as an area of said aperture.

6. The microphone of claim 1, wherein said plate protrudes away from said first exterior surface of said housing by a distance that is less than four times a wall thickness of said housing.

7. The microphone of claim 6, wherein said plate protrudes away from said first exterior surface by about 0.3 mm.

8. The microphone of claim 1, wherein said plate includes an interior recess that defines said passageway.

9. The microphone of claim 8, wherein said interior recess has a generally rectangular shape.

10. The microphone of claim 1, wherein said opening in said wall of said plate is the only sound opening in said plate.

11. The microphone of claim 10, wherein said aperture in said housing is the only sound aperture in said housing.

12. A microphone, comprising:

a housing defining an inner volume and including a first exterior surface with an aperture leading to said inner volume;

a transducing assembly within said housing for converting sound into an electrical signal; and a plate attached to said first exterior surface over said aperture and including a sound inlet port, said plate defining a passageway between said sound inlet port and said aperture for transmitting said sound to said inner volume, said passageway having a portion that transmits said sound in a direction generally parallel with said exterior surface, said plate having a cup-shape with a base wall and at least one wall extending away from said housing, said at least one wall being connected to said base wall, said base wall being spaced away from said first exterior surface of said housing and including said sound inlet port at a region where said base wall is spaced away from said first exterior surface, said sound inlet port being the only sound aperture in said plate for transmitting sound to said inner volume, and said plate protrudes away from said exterior surface of said housing by a distance that is less than 0.5 mm.

13. The microphone of claim 12, wherein said sound inlet port is offset from said aperture.

14. The microphone of claim 12, wherein said passageway defined by said plate is elongated.

15. The microphone of claim 12, wherein said passageway is also defined by said first exterior surface.

16. The microphone of claim 12, wherein said base wall of said plate is generally parallel with said exterior surface.

17. The microphone of claim 12, wherein said plate is designed so that said passageway has an acoustical inertance for achieving a selected dampening of a frequency response of said microphone.

18. The microphone of claim 12, wherein said aperture in said housing is the only sound aperture in said housing.

19. An electroacoustic transducer, comprising:

a housing defining an inner volume and including a first exterior surface with an aperture therein, said aperture being the only sound aperture that transmits sound into said inner volume;

a transducing assembly within said housing for transducing between an acoustic signal and an electrical signal; and a plate located on said first exterior surface and over said aperture, said plate, in combination with said first exterior surface, defines a passageway for transmitting said sound between said aperture and an opening in said plate that is offset from said aperture, said opening being in a wall on said plate that is generally parallel to and spaced away from said exterior surface, said plate protrudes away from said exterior surface of said housing by a distance that is less than about 0.5 mm.

20. The electroacoustic transducer of claim 19, wherein said electroacoustic transducer is a microphone and said plate is a sound inlet plate.

21. The electroacoustic transducer of claim 19, wherein said plate has a cup shape.

22. The electroacoustic transducer of claim 19, wherein said transducing assembly includes a backplate and a movable diaphragm.

23. The electroacoustic transducer of claim 19, wherein paid plate has a cup shape and includes an interior recess that defines said passageway, said opening in said plate leads to said interior recess.

24. The electroacoustic transducer of claim 23, wherein said electroacoustic transducer is a microphone and said recess is designed so that said passageway has an acoustical inertance for achieving a selected dampening of said frequency response for said microphone.

25. The electroacoustic transducer of claim 24, wherein said recess is of a generally rectangular shape.

26. The electroacoustic transducer of claim 24, wherein said passageway defined by said recess is elongated.

27. The microphone of claim 19, wherein said opening in said plate is the only sound opening in said plate.

28. A directional microphone, comprising:

a housing defining an inner volume and including a first exterior surface with two apertures leading to said inner volume;

a transducing assembly dividing said inner volume into a front volume and a rear volume, said transducing assembly for converting sound into an electrical signal; and a plate system coupled to said first exterior surface of said housing and including two sound inlet ports each corresponding to a respective one of said two apertures, said plate system defining two passageways each located between respective ones of said sound inlet ports and respective ones of said apertures for transmitting said sound to said inner volume in said housing, said two passageways being acoustically isolated from each other, said sound inlet ports being openings in at least one wall of said plate system, at least one sound inlet port being offset from said respective one of said two apertures in said first exterior surface, each of said sound inlets ports in said plate system receiving said sound from a sound receptacle of a hearing aid in which said microphone is mounted.

29. The microphone of claim 28, wherein said plate system includes interior recesses that define said passageways.

30. The microphone of claim 28, wherein said plate system protrudes away from said exterior surface of said housing by a distance that is less than about 0.5 mm.

31. The microphone of claim 28, wherein said plate system is designed so that said passageways have an acoustical inertance for achieving a selected dampening of a frequency response of said microphone.

32. The microphone of claim 28, wherein said plate system includes two independent plates.

33. A method of altering the frequency response of a microphone, comprising:

selecting a sound inlet plate having a non-planar geometry with a base wall and side walls extending away from said base wall, said side walls and said base wall forming a recess, said recess defines a sound passageway leading to an aperture in a housing of said microphone, said non-planar sound inlet plate having a sound opening in said base wall leading to said passageway, said passageway having a geometry resulting in a certain acoustic inertance; and attaching said sound inlet plate to said housing of said microphone such that said base wall having said sound opening is spaced away from and substantially parallel to said housing in a region of said aperture and said sound opening being coplanar with an external surface of said base wall.

34. The method of claim 33, wherein said sound inlet plate protrudes from said housing by a distance of less than 0.5 mm.

35. The method of claim 33, wherein said opening in said sound inlet plate is the only sound opening in said sound inlet plate.

36. The method of claim 35, wherein said aperture in said housing is the only sound aperture in said housing.

37. A microphone, comprising:

a housing defining an inner volume and including a first exterior surface with an aperture leading to said inner volume;

a transducing assembly within said housing for converting sound into an electrical signal;

a plate attached to said first exterior surface over said aperture and including a sound inlet port, said plate defining a passageway between said sound inlet port and said aperture for transmitting said sound to said inner volume, said passageway having a portion that transmits said sound in a direction generally parallel with said exterior surface; and wherein said aperture is near a corner of said housing and said sound inlet port is offset from said aperture toward a central region of said housing, said sound inlet port being on a wall of said plate that is spaced away from and substantially parallel to said housing and being coplanar with an external surface of said wall of said plate.

38. A directional microphone, comprising:

a housing defining an inner volume and including a first exterior surface with two apertures leading to said inner volume;

a transducing assembly dividing said inner volume into a front volume and a rear volume, said transducing assembly for converting sound into an electrical signal; and a plate system including two independent plates and coupled to said first exterior surface of said housing, a first plate including one sound inlet port corresponding to one of said two apertures, a second plate including one sound inlet port corresponding to the other of said two apertures, said plate system defining two passageways each located between respective ones of said sound inlet ports and said apertures for transmitting said sound to said inner volume in said housing, said sound inlet ports being openings in at least one wall of said plate system, at least one sound inlet port being offset from said respective one of said two apertures in said first exterior surface.

* * * * *